United States Patent [19]

Underwood

[11] 3,979,753

[45] Sept. 7, 1976

[54] PORTABLE BALLOON ANTENNA SUPPORT STRUCTURE

[76] Inventor: Lawrence E. Underwood, 24296 Hesperian Blvd., Hayward, Calif. 94545

[22] Filed: Apr. 11, 1975

[21] Appl. No.: 567,095

[52] U.S. Cl. ..... 343/706; 343/714

[51] Int. Cl.[2] ..... H01Q 1/28

[58] Field of Search ..... 343/706, 713, 714, 880, 343/881

[56] References Cited

UNITED STATES PATENTS 3,142,063 7/1964 Goetzmann ..... 343/706

*Primary Examiner*—Eli Lieberman

*Attorney, Agent, or Firm*—William R. Piper

[57] ABSTRACT

A portable antenna support structure which can be carried by a vehicle and includes an inflatable balloon and telescopic extension poles that are pivoted to the sides of the vehicle at the front and back and may be extended radially when the vehicle is at rest. The vehicle carries a storage tank of compressed helium which can be transferred to the balloon for inflating it, the balloon being equipped with an antenna. Guy lines extend from a winch on the vehicle and are passed around pulleys arranged at the outer ends of the fully extended telescopic poles and then are secured to the balloon for holding it and the antenna in a fixed position and at a desired height above the vehicle. The balloon may be pulled down to the vehicle by the winch where the helium may be withdrawn from the balloon for collapsing it and the gas may be compressed in the storage tank until its next use.

4 Claims, 5 Drawing Figures

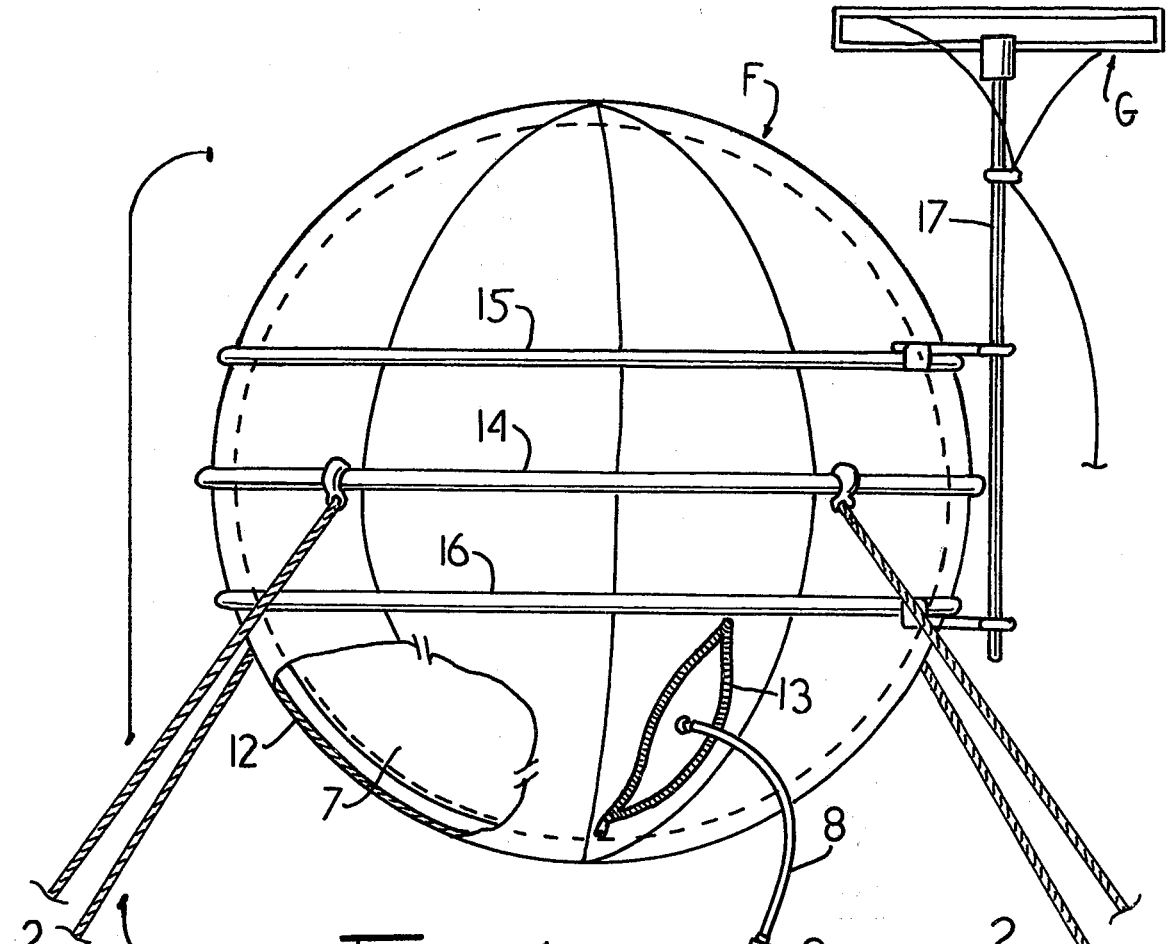
FIG. 1
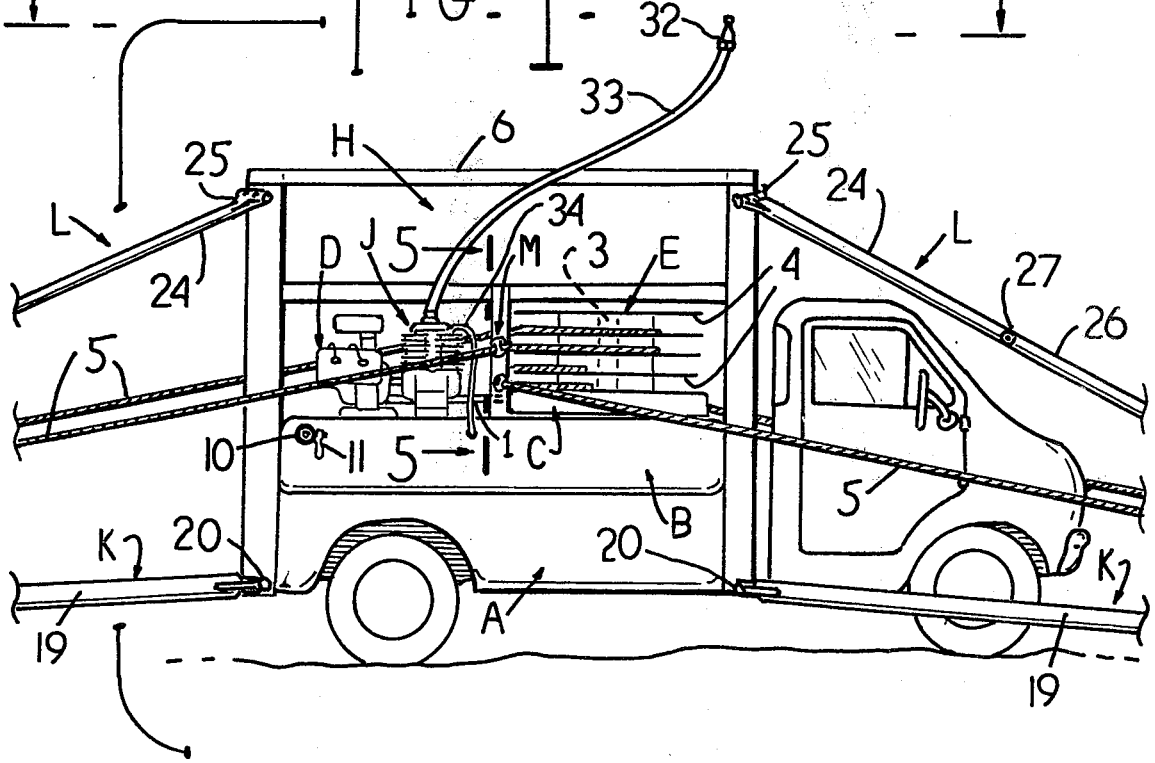

PORTABLE BALLOON ANTENNA SUPPORT STRUCTURE

SUMMARY OF THE INVENTION

An object of my invention is to provide an improvement over my patent on an antenna support structure, U.S. Pat. No. 3,045,952, issued on July 24, 1962. In my patent the device was not portable. The guy lines extending from the balloon were passed around pulleys which in turn were anchored to piers set in the ground. Then the guy lines extended to a group of pulleys mounted on a central common shaft, one pulley for each guy line. The shaft was rotatable in a bracket mounted on a stationary pier. The inflated balloon carried the antenna and it was designed to hold the antenna in a permanent position at a desired height.

The present invention is designed to make the device portable so that it can readily be moved from place to place. For example, the balloon when inflated could support a U.H.F. horn or any kind of electronic signal receiver. The device could then be moved from place to place and at each place the balloon could be inflated from the compressed helium in the storage tank on the truck and could lift the antenna, U.H.F. horn, or other kind of signal receiver to a height where the best electronic signal reception would be received. The height of the balloon would then be checked and a permanent electronic signal receiving device take its place. Then the balloon could be lowered and deflated by withdrawing the helium gas therefrom and transferring and compressing the gas in the storage tank. The deflated balloon would take up far less space in its collapsed condition and the truck could be driven to its next location where the entire operation would be repeated.

DESCRIPTION OF THE DRAWINGS

FIG. 1 is an exploded schematic view illustrating the balloon inflated and supporting an antenna at a desired height above the truck that is used for transporting the balloon when the latter is deflated and collapsed. The truck is also shown in side elevation with portions of its telescopic poles in extended operative positions.

DESCRIPTION OF THE PREFERRED EMBODIMENT

Figure 2:
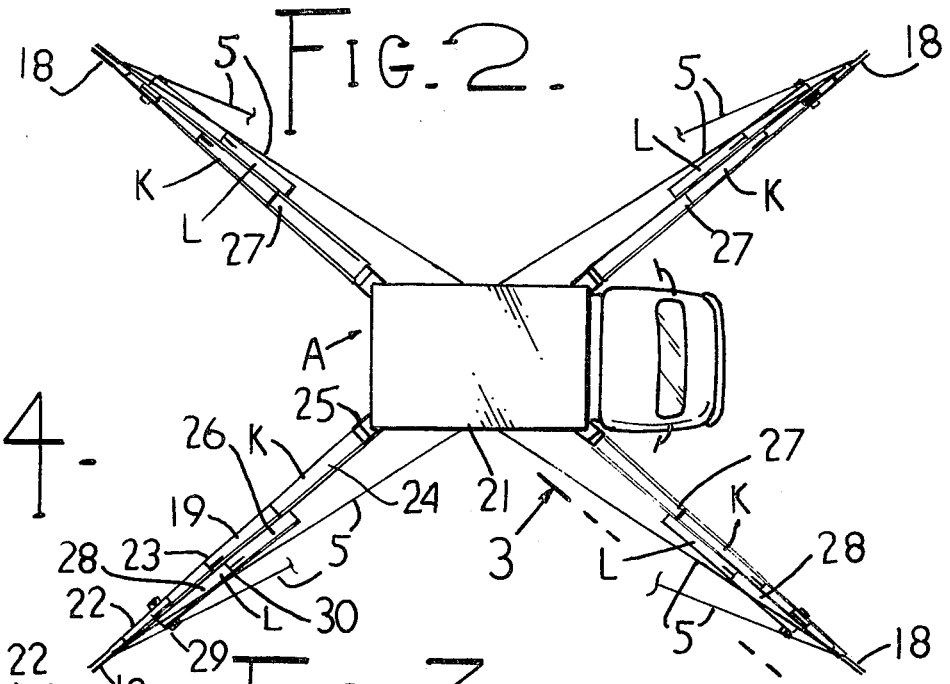
FIG. 2 is a top plan view of the vehicle on a much smaller scale and is taken along the line 2—2 of FIG. 1. Four telescopic poles are shown in extended position and radiating from the truck body in lateral directions from opposite sides of the truck.

In carrying out my invention I provide a vehicle, indicated generally at A in FIGS. 1 to 4 inclusive. The vehicle has a storage tank B, see FIG. 1, for storing helium or other lighter than air gas in a compressed state. Above the storage tank B, I mount a winch drive mechanism, indicated generally at C in FIG. 5 and including a winch drive shaft 1. Again referring to FIG. 1, the winch drive shaft 1 extends to an engine D which is used for operating the shaft and winch E. A gear engaging or release handle 2, see FIG. 5, may be manually actuated for operatively connecting the shaft 1 to the shaft 3 of the winch E for causing the drums 4, which are keyed to the shaft 3, to wind up guy lines 5 thereon to pull in a balloon F in a manner hereinafter described. Also the handle 2 may be actuated for freeing the winch drive shaft 1 from the drum supporting shaft 3 for permitting the drums to free wheel while allowing the inflated balloon F to rise to a desired height and carry with it an antenna G or other electronic signal receiver, such as a U.H.F. horn.

Figure 5:
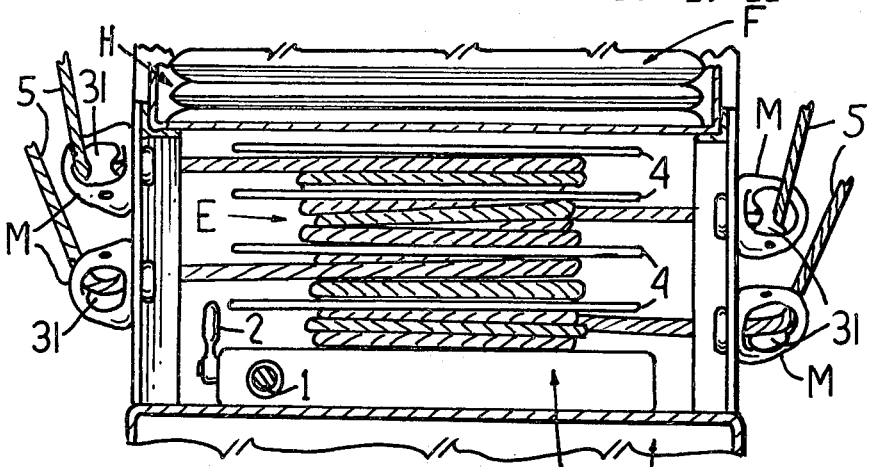
FIG. 5 is an enlarged transverse section taken along the line 5—5 of FIG. 1, and shows the winch in elevation with its plurality of drums mounted on a common shaft, there being one drum for each guy line.

A balloon storage compartment H is placed above the winch E and it is designed to hold the balloon F when the latter is collapsed and folded as is shown in FIG. 5. A cover 6 may enclose the top of the balloon storage compartment H, see FIGS. 1 and 2. To the rear of the winch E, I place a compressor J and this compressor is operatively connected to the engine D. The purpose of the compressor is to withdraw helium gas from the balloon F and to force the gas into the storage tank B, when it is desired to deflate the balloon and store it in the compartment H.

I will now describe the balloon F more in detail and will set forth how the guy lines 5 are connected to it for holding the inflated balloon at a desired elevation above the vehicle A, see FIG. 1. The balloon includes an inflatable inner bladder 7 which has a short tube 8 extending therefrom and provided with a valve and connector 9 at its free end. When the balloon F is to be inflated, it is removed from the compartment H and the valve connector 9 is secured to a coupling 10 that is in communication with the compressed helium in the storage tank B. A shut-off valve 11 can be opened when the valve-connector 9 is secured to the coupling 10. The compressed helium gas will now flow from the tank B into the bladder 7 for inflating it. As soon as the proper amount of gas has been transferred to the bladder 7, the shut-off valve 11 is closed and the valve-connector 9 removed from the coupling 10. The tube 8 is tucked inside an outer covering 12 and a zipper 13 closes the opening in the outer cover 12 through which the tube 8 extended.

FIG. 1 shows the inflated spherical balloon F with a tubular band 14 extending around its equator and connected to the outer casing 12. The ends of the guy lines 5 are connected to the tubular band 14. Above and below the central tubular band 14, I show auxiliary bands 15 and 16 and these parallel the central band and are secured to the outer casing 12 of the balloon F. The auxiliary bands 15 and 16 support the upright 17 which in turn carries the antenna G or other type of electronic receiving signal. I do not wish to be confined to a spherical balloon F because the balloon may be of any configuration desired.

I will now describe how the guy lines 5 extend from the drums 4 of the winch E to the balloon F and how these guy lines extend around pulleys 18 that are mounted at the outer ends of telescopic extension poles K, see FIGS. 2 to 5 inclusive. I have shown four of these poles K extending from the vehicle A, although I do not wish to be confined to any exact number. Since all of the extension poles are identical in construction, a detailed description of one will suffice for all.

Figure 4:
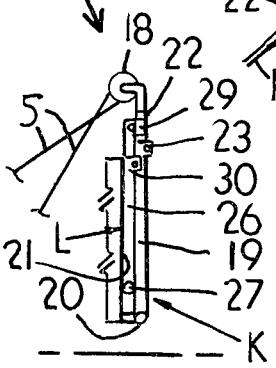
FIG. 4 is on the same scale as FIG. 3, and illustrates the telescopic pole in retracted and folded position which is the position the poles will occupy when the vehicle is in transit or is not being used.
Figure 3:
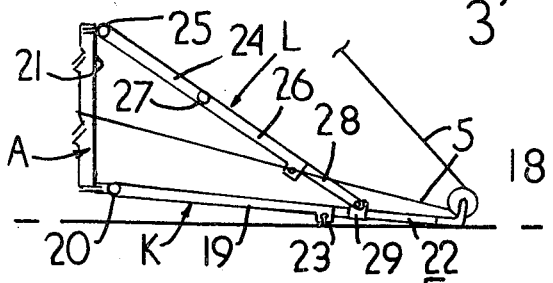
FIG. 3 is an enlarged detail of one of the telescopic poles shown in fully extended and operative position from the side of the vehicle. The view of FIG. 3 is taken when looking in the direction of the arrows 3—3 of FIG. 2.

In FIG. 3, I show one of the telescopic poles K fully extended and in operative position, while in FIG. 4 the pole is shown in retracted and inoperative position. Referring first to FIG. 3, it will be seen that the pole K has an inner section 19 pivoted at 20 to the side 21 of the vehicle A. The inner section 19 has an outer section 22 with a portion slidably received within the inner section. A tightening member 23, disposed adjacent to the outer end of the inner section 19, may be tightened for securing the outer section 22 in extended position. The pulley 18 is mounted at the free end of the outer section 22.

A telescopic bracing member L consists of an inner arm 24 that is pivoted at 25 to the side 21 of the vehicle A at a point above the pivot 20 for the inner section 19 of the telescopic pole K, see FIG. 3. An outer telescopic arm of the brace has an inner section 26 pivoted at 27 to the outer end of the arm 24. The outer section 28 of the telescopic arm has a portion slidably received within the inner section 26 and a sleeve 29 is pivotally carried at the outer end of the section 28 and slidably receives the outer section 22 of the pole K. When the telescopic extension pole K is fully extended, as shown in FIG. 3, it will preferably project at an angle from the side 21 of the vehicle A, see FIG. 2. The telescopic bracing member L will be extending downwardly at an angle from the pivot point 25 at the side 21 of the vehicle down to the outer section 22 of the pole K. The inner section 26 of the brace L will be in alignment with the arm 24 and the pivot may have a lock nut, not shown, for preventing the inner section 26 from accidentally swinging about the pivot 27. The sleeve 29 is also clamped in position on the outer section 22 of the telescopic pole K and this arrangement will hold the pole K in extended position and will stop the pole from swinging upwardly about its pivot 20. Also the inner and outer telescopic sections 26 and 28, which are pivotally connected to the arm 24 at 27 are secured in adjusted position by a tightening joint 30 disposed at the outer end of the section 26. FIG. 3 shows one of the guy lines 5 extending from the winch E, not illustrated in this Figure, to the pulley 18 and then extending upwardly to the balloon F, which is shown in FIG. 1.

FIG. 4 shows the telescopic extension pole K in a collapsed and upright position paralleling the side 21 of the vehicle A. It also shows the arm 24 of the brace L swung downwardly and the telescopic outer portion of the brace consisting of the inner section 26 and outer section 28 extending upwardly from the pivot 27. The pole K and the brace L are now in inoperative position. What I have described for one of the extensible poles K and its brace L holds true for all of the other extensible poles and their braces and like characters will be applied to similar parts.

In FIG. 5, I show an enlarged detail of the novel manner in which the guy lines 5 are fed to their respective drums 4 on the winch E. Each guy line is passed around a pulley 31, which in turn is rotatably mounted in a free swinging bracket M. The brackets M, one for each guy line 5, are swingably mounted on uprights 32 that project upwardly from the top of the helium storage tank B to the bottom of the balloon storage compartment H, see also FIG. 1. The brackets M are free to swing about their pivotal connections with the uprights 32 as the guy lines 5 are either wound up on their respective drums 4 during the hauling down of the balloon F, or are unwound from the drums during the ascent of the inflated balloon. Also, the brackets M will swing about their pivotal connections on the uprights 32 as the extensible poles K and their braces L are retracted and swung from their operative positions, shown in FIGS. 1, 2 and 3, into their inoperative and upright positions in FIG. 4.

OPERATION

From the foregoing description of the various parts of the device, the operation thereof will be readily understood. FIG. 5 shows the balloon F collapsed and packed in the storage compartment H. The extensible poles K and their braces L will be in an upright and inoperative position 4 when the vehicle A is ready to transport the device to a selected location. The helium in the balloon F has been transferred to the storage tank B and has been compressed.

When the device is to be used, the vehicle A is driven to the selected cite and then the poles K are extended as well as the braces L in the manner previously described. The cover 6 for the top of the balloon compartment H is removed and the collapsed balloon F is removed from the compartment. The zipper 13, see FIG. 1, for the outer cover 12 of the balloon is opened to free the tube 8, which extends from the inner bladder 7 of the balloon. The valve 9 at the outer end of the tube 8 is connected to the coupling 10 of the storage tank B and the handle of the shut-off valve 11 is opened to permit the compressed helium in the tank B to flow into the balloon F for inflating it. When this is accomplished the shut-off valve 11 is closed and the valve and connector 9 are disconnected from the coupling 10 whereupon the tube 8 may be tucked into the interior of the outer covering 12 and the zipper 13 closed. The valve 9 at the end of the tube 8 will remain closed and will prevent the escape of the helium from the balloon. The operator now permits the inflated balloon F to ascend and carry with it the antenna G, or any other desired electronic signal receiving device. He actuates the handle 2, shown in FIG. 5, for freeing the winch E from the engine by freeing the winch drive shaft 1 from the engine shaft. The inflated balloon F will ascend and the guy lines 5 will unwind from the drums 4. When the proper height is reached by the balloon for causing the best reception to be received by the antenna G, or other signal receiving device, the ascent of the balloon is stopped by stopping the free rotation of the winch and its drums. The height of the antenna above the ground is now carefully measured so that the permanent signal receiving device will be positioned at this same height.

When the above operation is completed, the operator may connect the winch E to the engine D by actuating the handle 2, see FIG. 5, for connecting the winch drive shaft 1 to the engine shaft. This will cause the drums 4 to wind up the guy lines 5 and pull down the inflated balloon F to a height where the operator can open the zipper 13 of the outer balloon casing 12 and connect the valve-connector 9 at the end of the tube 8, to another connector 32 mounted at the free end of another tube 33 that leads to the compressor J, see FIG. 1. The compressor is now started and will withdraw the helium gas from the balloon and compress it while forcing the gas into the storage tank B through the pipe 34. The valve in the valve-connector 9 will be automatically opened when the connector 9 is coupled to the connector 32. In this way the gas is free to flow through the connected tubes 8 and 33 during the time the compressor is withdrawing the gas from the balloon and compressing and forcing this gas into the tank B.

As soon as the balloon is deflated, the valve-connector 9 may be disconnected from the connector 32 and the collapsed balloon may be stored in this storage compartment H and the cover 6 placed over the compartment. Next, the extensible poles K and their braces L may be collapsed and swung into the vertical inoperative position shown in FIG. 4. The vehicle is now ready for the next move.

I claim:

1. In combination:

a. a vehicle movable over the ground;

b. a storage tank in the vehicle for holding a lighter than air gas under compression;

c. a compartment in the vehicle for holding a balloon when deflated;

d. a winch in the vehicle and carrying a plurality of drums with guy lines leading from the drums and attached to the balloon, the balloon having a tube connectible to a valve-controlled outlet for said storage tank for feeding the compressed gas into the balloon for inflating it; and e. poles pivotally secured to both sides of the vehicle and swingable from inoperative to operative positions and carrying pulleys at their outer ends around which the guy lines are passed, the poles spacing the pulleys so that the guy lines will hold the inflated balloon in a desired position above the vehicle, the balloon supporting an electron wave receiving device at a desired height.

2. The combination as set forth in claim 1: and in which a. a gas compressor is carried by the vehicle; and b. the tube from the balloon being connectible to said compressor for withdrawing the gas from the balloon, compressing it and delivering the compressed gas into said storage tank;

c. whereby the deflated balloon can be stored in said compartment and said poles can be swung into inoperative position so that the vehicle can move to another location.

3. The combination as set forth in claim 1: and in which a. said poles have telescopic sections which are extensible when the poles are swung into operative position for positioning the pulleys at a distance from each side of the vehicle for causing the guy lines to stabilize the position of the inflated balloon; and b. extensible braces for said poles for holding said poles in extended position.

4. The combination as set forth in claim 1: and in which a. idler pulleys are mounted adjacent to said drums, the guy lines being passed around said idler pulleys, the mountings for said idler pulleys being of the swivel type so as to permit the free swinging of said idler pulleys about their mountings during the paying out or the taking in of the guy lines; and b. means for operating the winch for causing the drums to wind in the guy lines when it is desired to lower the inflated balloon.

* * * * *